United States Patent [19]

Chang et al.

[11] 4,088,488

[45] May 9, 1978

[54] PHOTOGRAPHIC ELEMENTS CONTAINING NITROXYL RADICAL OXIDANTS

[75] Inventors: Jack C. Chang; Peter A. Marr, both of Webster; Samuel J. Ciurca, Jr., Rochester, all of N.Y.

[73] Assignee: Eastman Kodak Company, Rochester, N.Y.

[21] Appl. No.: 635,018

[22] Filed: Nov. 25, 1975

Related U.S. Application Data

[63] Continuation of Ser. No. 367,304, Jun. 5, 1973, abandoned.

[51] Int. Cl.[2] ..... G03C 7/00; G03C 5/54; G03C 1/40; G03C 1/48

[52] U.S. Cl. ..... 96/29 D; 96/3; 96/54; 96/55; 96/76 R; 96/77; 96/95; 96/119 R

[58] Field of Search ..... 96/3, 29 D, 54, 55, 96/60 R, 76 R, 77, 95, 119, 73, 74

[56] References Cited

U.S. PATENT DOCUMENTS

| | | | |
|---|---|---|---|
| 2,559,643 | 7/1951 | Land | 96/76 R |
| 2,661,293 | 12/1953 | Land | 96/76 R |
| 2,698,798 | 1/1955 | Land | 96/76 R |
| 2,892,710 | 6/1959 | Cohler et al. | 96/95 |
| 2,992,105 | 7/1961 | Corley et al. | 96/29 D |
| 3,065,074 | 11/1962 | Rogers | 96/29 D |
| 3,173,929 | 3/1965 | Kasman | 260/378 |
| 3,384,484 | 5/1968 | Schranz et al. | 96/77 |
| 3,698,897 | 10/1972 | Gompf et al. | 96/77 |
| 3,709,690 | 1/1973 | Cohen et al. | 96/67 |
| 3,880,658 | 4/1975 | Lestina et al. | 96/29 D |

FOREIGN PATENT DOCUMENTS

| | | |
|---|---|---|
| 2,126,954 | 12/1971 | Germany. |
| 1,326,889 | 8/1973 | United Kingdom. |

*Primary Examiner*—Edward C. Kimlin
*Assistant Examiner*—Richard L. Schilling
*Attorney, Agent, or Firm*—Ronald P. Hilst

[57] ABSTRACT

Stable nitroxyl radicals are useful as oxidants in photographic elements or film units.

9 Claims, No Drawings

PHOTOGRAPHIC ELEMENTS CONTAINING NITROXYL RADICAL OXIDANTS

This is a continuation, of application Ser. No. 367,304, filed June 5, 1973, now abandoned.

FIELD OF INVENTION

This invention relates to the art of photography and particularly to photographic elements, such as color diffusion transfer elements, employing oxidizing agents.

BACKGROUND OF THE INVENTION

Color diffusion transfer processes generally involve the use of a photographic element comprising a support, at least one silver halide emulsion and an image dye-providing material which is contained in or contiguous said layer. After exposure, such a photographic element is treated with an alkaline processing solution to effect imagewise discrimination in the element. As is well known in the art, the dye-providing material can be initially immobile or initially mobile in the processing solution. Upon alkaline processing of an initially immobile dye-providing material, a mobile dye or dye precursor can be released imagewise or the material can be imagewise rendered soluble and thus mobile. If the material is initially mobile, the processing solution typically renders the material insoluble (and thus immobile) in an imagewise fashion. Whether initially mobile or immobile, upon treatment with a processing solution, the dye-providing material typically is oxidized under alkaline conditions thereby producing imagewise discrimination in the element.

Exemplary of such color diffusion transfer processes are those using developing agents as disclosed in U.S. Pat. Nos. 2,698,798 and 2,559,643 wherein a latent silver halide image is developed with a color developing agent. As development proceeds, the color developing agent reduces the exposed silver halide to metallic silver and the color developing agent which is oxidized as a function of development forms an immobile species while the unoxidized color developing agent is free to migrate to a receiving element. After migration, the color developing agent in the receiver is oxidized. The oxidized developing agent then self-couples or couples with a color coupler to form a positive dye image.

A more recent example of a photographic process in which oxidation causes formation of an image dye is described in copending Lestina and Bush U.S. application Ser. No. 308,869, filed Nov. 22, 1972, now U.S. Pat. No. 3,880,058, and entitled PHOTOGRAPHIC ELEMENTS CONTAINING OXICHROMIC COMPOUNDS. Those oxichromic compounds are ones which undergo chromogenic oxidation to form a new chromophore. Useful materials of that type are oxichromic compounds which contain a developing moiety and an oxichromic moiety and have the general formula D-(OC) wherein D is a group which is a silver halide developer such as hydroquinone moiety and OC is a moiety which undergoes chromogenic oxidation to form an image dye. These oxichromic compounds are particularly useful in an image transfer unit format in which the respective initially diffusible oxichromic compounds or the initially nondiffusible compounds are used in combination with the appropriate silver halide emulsions.

In order to achieve optimum results when using such oxichromic compounds, it is desirable to have an oxidant which can be easily incorporated in a photographic element with good stability and which will readily oxidize the oxichromic moiety without adversely affecting other ingredients of a given photographic element or film unit. The oxidative conversion of oxichromic compounds or of other color-providing materials is necessary in order to achieve color image formation. Accordingly, there is a continuing need in the art for materials which exhibit suitable oxidation capability.

SUMMARY OF THE INVENTION

We have found a class of oxidants well suited for use in color diffusion transfer color elements and in any other photographic element in which an oxidant is a necessary or desirable ingredient. When used in photographic elements containing certain oxichromic compounds, the oxidant produces selective oxidation of the oxichromic moiety.

DESCRIPTION OF PREFERRED EMBODIMENTS

The objects of the present invention are achieved through the use in photographic elements, e.g., a color diffusion transfer element, of a class of stable free nitroxyl radicals. Typically, these compounds are used in a photo-sensitive element comprising a support having thereon at least one photographic image recording layer, and at least one layer containing a stable free nitroxyl radical of this invention.

As is well known in the literature, nitroxyl radicals are compounds containing the >N-O group which has one unpaired electron. The structure of this fragment can be conceived as a superposition of two resonance structures:

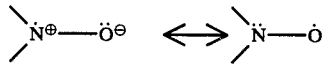

(1) (2)

The contribution of either structure (1) or (2) to the ground state may be different, depending on the effects of conjugation and polarity of the medium. Hereinafter, the nitroxyl radicals will be represented simply by resonance structure (2) in accordance with accepted practice.

Stable free nitroxyl radicals useful in this invention include those compounds represented by the formula:

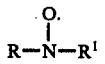

I.

wherein:

R and $R^1$, when taken separately, represent (1) an alkyl group having no hydrogen on the carbon atom in the $\alpha$-position relative to (i.e., immediately adjacent) the nitrogen atom and having 1 to about 5 carbon atoms and including substituted alkyl having the same range of carbon atoms and no $\alpha$-hydrogen or (2) a substituted aryl group having about 6 to 25 carbon atoms having such substituents as alkyl of up to about 19 carbon atoms, alkoxy of up to about 19 carbon atoms, nitro, etc; and R and $R^1$, when taken together, represent the nonmetallic atoms necessary to complete a 5-, 6- or 7-membered heterocyclic ring having no hydrogen on the α-carbon atoms (i.e., those immediately adjacent the nitrogen atom).

Preferred materials are those having the formula:

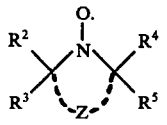

II.

wherein:

$R^2$, $R^3$, $R^4$ and $R^5$, when taken separately, can each represent a lower alkyl group having about 1 to 5 carbon atoms;

$R^2$ and $R^3$ or $R^4$ and $R^5$, together with the carbon atoms to which they are attached can represent (1) the carbon atoms necessary to form a 5- or 6-membered cycloalkyl or cycloalkenyl nucleus including corresponding substituted 5- or 6-membered cyclic nuclei having from about 5 to 25 carbon atoms or (2) an imino group (=NH) including substituted imino (=NR) wherein R is an alkyl group having 1 to about 25 carbon atoms or (3) another heterocyclic nitroxyl radical;

one of $R^3$ and $R^5$, when taken with Z, can represent a double bond in the cyclic nucleus formed by Z, in which case $R^2$ or $R^4$, respectively, represents (1) an aryl group having about 6 to 25 carbon atoms, including substituted aryl (e.g., tolyl, aminophenyl, diethylaminophenyl, chlorophenyl, diphenylaminophenyl) or (2) an amino radical including substituted amino (e.g., dimethylamino, methylethylamino, methylphenylamino); and Z represents the nonmetallic atoms necessary to complete a 5-, 6- or 7-membered heterocyclic nucleus having up to two nitrogen hetero atoms and including substituted 5-, 6- or 7-membered heterocyclic nuclei having such substituents as alkyl having 1 to about 25 carbon atoms, aryl having 1 to about 25 carbon atoms including substituted aryl, amino including alkyl and aryl substituted amino, substituted carbonamido, substituted sulfonamido, substituted carbonyloxy, oxo (=O), imino (=NH) including substituted imino (e.g., =NR, where R is alkyl, etc), hydroxy, an oxygen atom, and the like.

Various synthetic techniques for preparing nitroxyl radicals useful in this invention are described in "Free Nitroxyl Radicals," E. G. Rozantsev, Plenum Press, New York, 1970. A large number of stable radicals can be prepared from heterocyclic amines which have no hydrogen on the carbon atoms α- to the nitrogen atoms such as di-t-alkylamines, t-alkylarylamines, etc. Those amines are oxidized with hydrogen peroxide in the presence of (1) phosphotungstic acid or (2) a salt of vanadium, molybdenum or tungsten. Diarylamines are oxidized to the corresponding diarylnitroxyl with perbenzoic acid at 0° C. Heterocyclic nitroxyls having more than one heteroatom (e.g., porphyrexide) are also known in the art as are methods for their preparation. Similarly, binitroxyls and conjugated biradicals are also known. See, for example, "Organic Chemistry of Stable Free Radicals," Forrester et al, 1968.

Representative compounds useful in accordance with this invention are shown in the following Table I.

Table I

| Oxidant No. | Structural Formula |
|---|---|
| 1 | 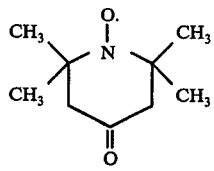 |
| 2 | 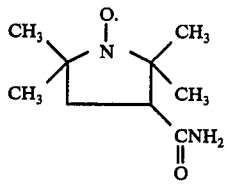 |
| 3 | 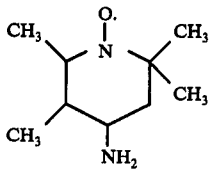 |
| 4 | 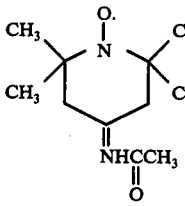 |

Table I-continued
| Oxidant No. | Structural Formula |
|---|---|
| 5 | 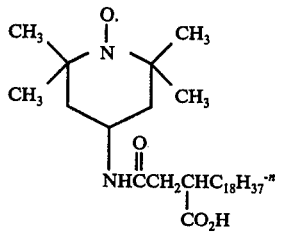 |
| 6 | 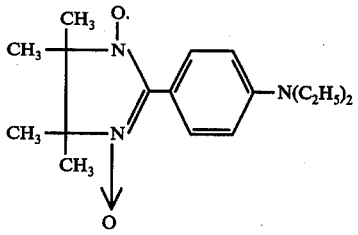 |
| 7 | 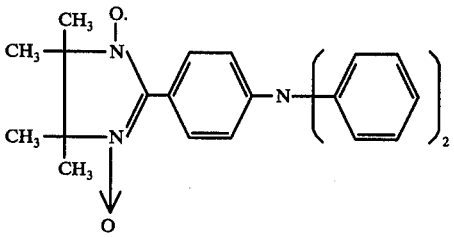 |
| 8 | 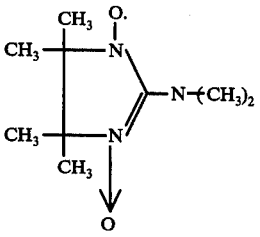 |
| 9 | 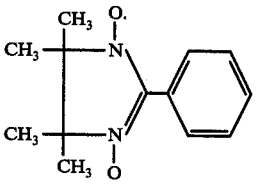 |
| 10 | 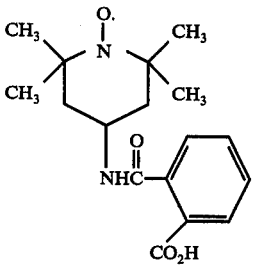 |

Table I-continued
| Oxidant No. | Structural Formula |
|---|---|
| 11 | 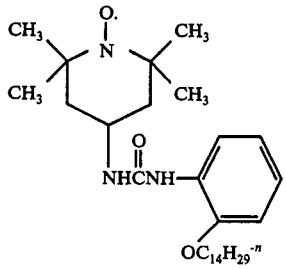 |
| 12 | 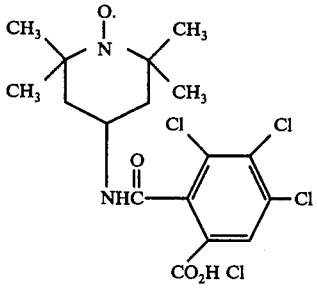 |
| 13 | 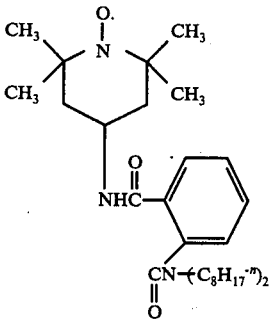 |
| 14 | 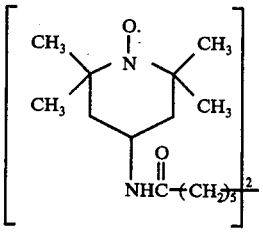 |
| 15 | 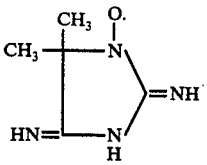 |
| 16 | 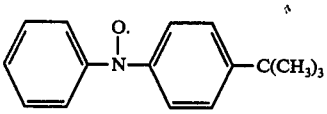 |

Table I-continued
| Oxidant No. | Structural Formula |
|---|---|
| 17 | 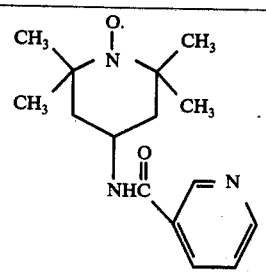 |
| 18 | 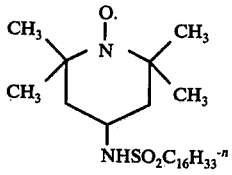 |
| 19 | 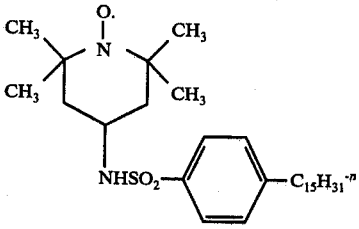 |
| 20 | 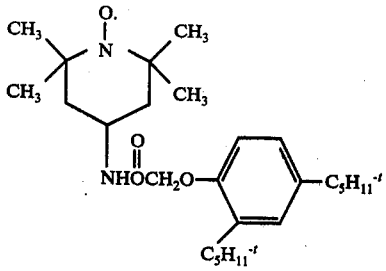 |
| 21 | 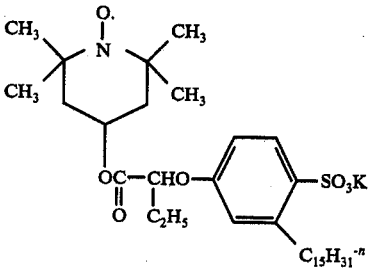 |
| 22 | 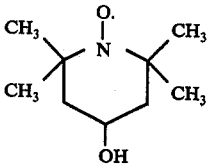 |
| 23 | 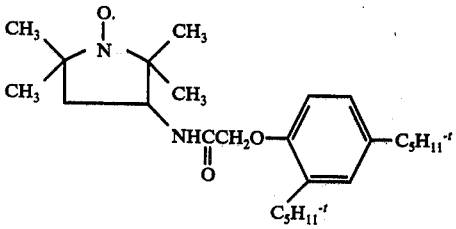 |

Table I-continued
| Oxidant No. | Structural Formula |
|---|---|
| 24 | 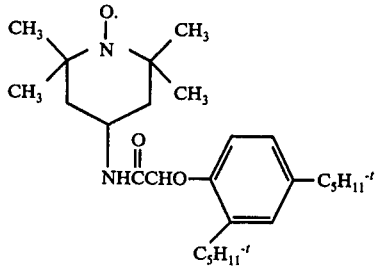 |
| 25 | 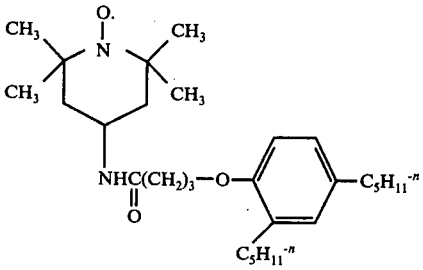 |
| 26 | 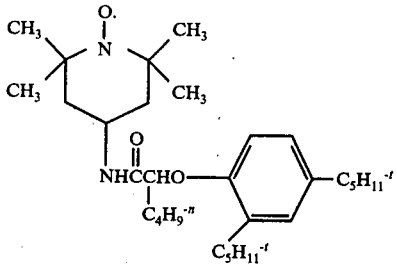 |
| 27 | 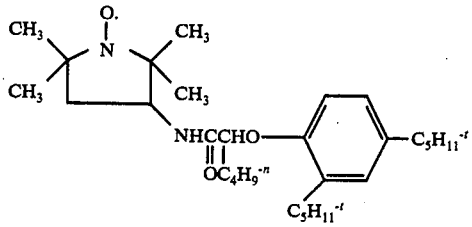 |
| 28 | 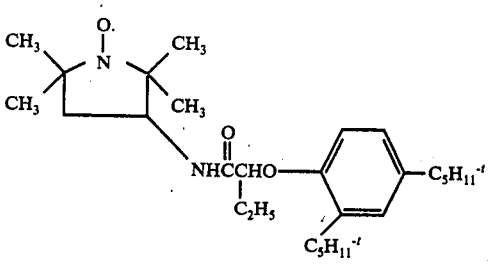 |
| 29 | 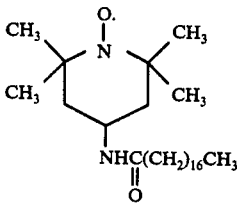 |

Table I-continued
| Oxidant No. | Structural Formula |
|---|---|
| 30 | 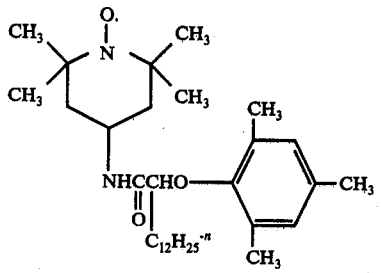 |
| 31 | 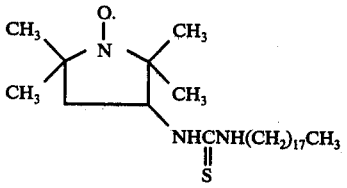 |
| 32 | 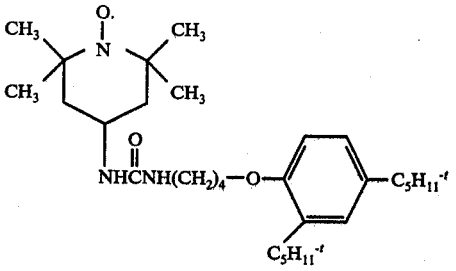 |
| 33 | 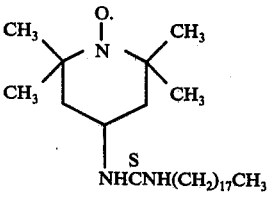 |
| 34 | 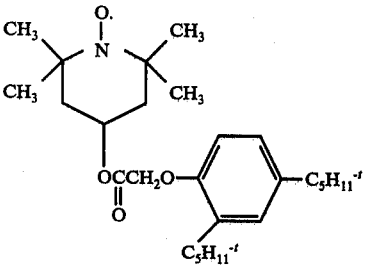 |
| 35 | 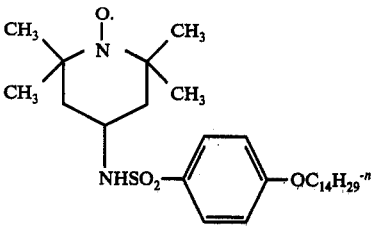 |

Table I-continued

| Oxidant No. | Structural Formula |
|---|---|
| 36 | 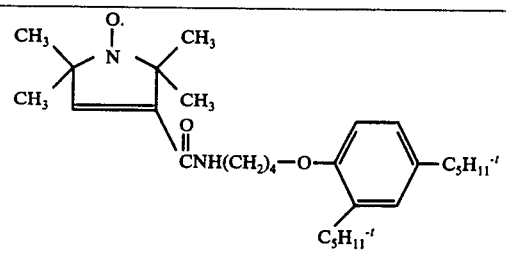 |
| 37 | 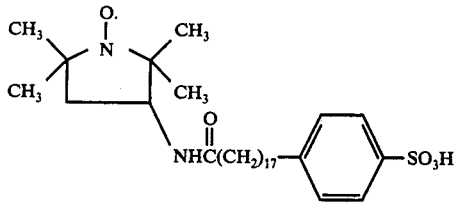 |
| 38 | 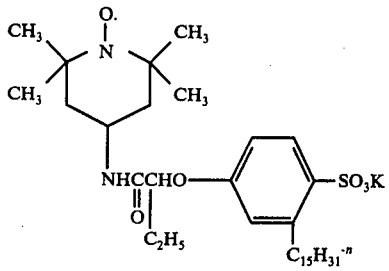 |
| 39 | 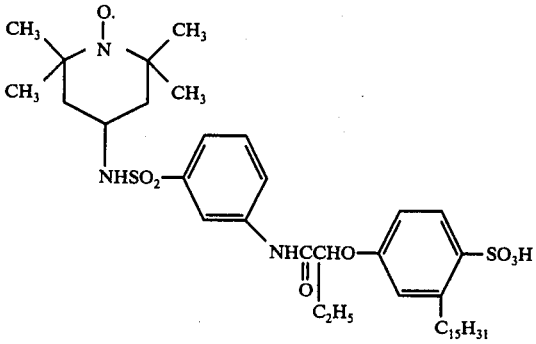 |
| 40 | 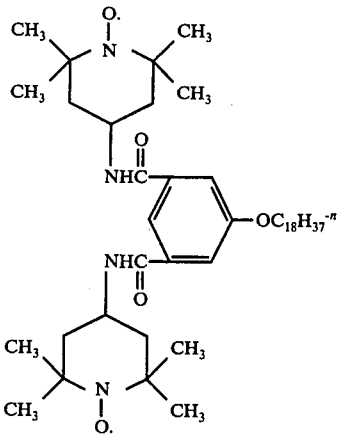 |

The oxidants of this invention can have attached a suitable ballasting group, typically, a long-chain organic moiety, in order to prevent migration of the oxidant throughout the photographic element. If, in the particular photographic process of use, oxidant migration is not detrimental, then the present compounds need not be ballasted. The free nitroxyl radicals of this invention can also be colored, provided the coloration of the oxidant does not adversely effect image quality. In a format wherein the oxidant remains behind an opaque layer where it cannot be viewed, the coloration of the oxidant will not interfere with image quality. Of course, colorless or low color nitroxyl radicals, which at most give rise to only a very low Dmin., are particularly preferred in that such materials are more versatile. A colorless or low color oxidant can be positioned in a film unit in any place that a colored oxidant could be located. In addition, a low color oxidant can be positioned, for example, in an image-receiving element where it is not hidden from view. Because of their greater versatility, nitroxyl radicals having the following formula are particularly preferred:

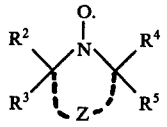

III.

wherein:

$R^2$, $R^3$, $R^4$ and $R^5$, when taken separately, represent a lower alkyl group having 1 to about 5 carbon atoms;

$R^2$ and $R^3$ or $R^4$ and $R^5$, together with the carbon atoms to which they are attached, represent the carbon atoms necessary to form a 5- or 6-membered cycloalkyl or cycloalkenyl nucleus; and Z represents the carbon atoms necessary to complete a 5- or 6-membered heterocyclic nucleus including a substituted 5- or 6-membered heterocyclic nucleus having such substituents as alkyl having 1 to about 25 carbon atoms, acyl having 1 to about 25 carbon atoms, amino, substituted carbonamido, substituted sulfonamido, substituted carbonyloxy, oxo (=O), hydroxy and the like. Typically, when the heterocyclic nucleus formed by Z is a substituted 6-membered ring, the substituents referred to above are in the 4- or para-position relative to the nitrogen atom of the Formula III. Among the useful substituents are long chain ballast groups such as alkyl groups generally having more than eight carbon atoms and which usually are attached to the heterocyclic nucleus via the carbonamido, sulfonamido, carbonyloxy, etc, moieties referred to above.

Among the preferred ballasted compounds of this invention are those having the formulas below:

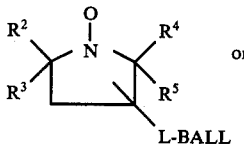

IV.

or

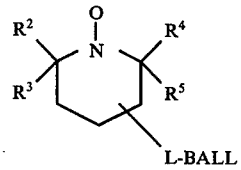

V.

wherein:

$R^2$, $R^3$, $R^4$ and $R^5$ are as described for Formula III above:

L is a linking or connecting group such as alkylene, imino (—NH—), carbonamido (—NHCO—), ureylene (—NHCONH—), thioureylene (—NHCSNH—), oxymethylenecarbonamido (—$NHCOCH_2O$—), carbonyloxy (—COO—), carbonate (—OCOO—) and the like; and BALL represents an organic ballasting group of such size and configuration (e.g., simple organic groups or polymeric groups) as to render the compound nondiffusible, especially during treatment with an alkaline processing composition. This ballasting group typically contains an alkyl group (branched or unbranched), an aryl group, an aralkyl group or an alkaryl group and typically contains from about 8 to 25 carbon atoms.

The term "stable" as used in connection with the present nitroxyl radicals has reference to the fact that these compounds exist as free radicals without self-decomposing for a period of time extending at least until the imaging process is substantially complete.

The nitroxyl radicals described herein can be used in a wide variety of photographic elements or in photographic film units.

In certain embodiments, the nitroxyl radicals can be used in photographic elements or film units to provide an oxidant for the synthesis of image dyes. The nitroxyl radicals can be used to generate oxidized color developing agent which then reacts with a color coupler to form the image dye. Additionally, these radicals can be used to oxidize a compound directly to an image dye as in the case of leuco indoanilines, leuco indophenols, leuco triarylmethanes and other dye precursors.

In one embodiment, the present nitroxyl radicals are useful in color diffusion transfer processes such as those in which unreacted color formers in undeveloped or partially developed areas of a photographic element diffuse imagewise, after color development of the exposed layers, to a receiving layer in which the color formers react with oxidized color developer to produce an imagewise distribution of dye. By including a nitroxyl radical in the receiving layer or having it in association therewith, dyes are formed imagewise in that element as a result of the interreaction of the oxidant, color developer and diffused color former. Processes of this type are described further in British Pat. No. 926,462, dated May 15, 1963, incorporated herein by reference.

Examples of processes in which an image is formed upon oxidation of transferred color developer and color coupler are described in U.S. Pat. Nos. 2,559,293 and 2,698,798, incorporated herein by reference. Similarly, the present oxidants can be used in imaging processes based on leuco anthraquinones and other dye precursors which produce dyes when oxidized or processes based on developers which self-couple upon oxidation, thereby producing dyes. Processes of these latter types are described further in U.S. Pat. Nos. 2,892,710 and 2,698,798, respectively, both incorporated herein by reference. Likewise, the described nitroxyl radicals have utility in color diffusion transfer processes using a leuco developing agent, as discussed in U.S. Pat. Nos. 2,992,105 and 2,909,430, incorporated herein by reference.

In another embodiment, the nitroxyl radicals can be used to oxidize the developer portion of a dye developer (i.e., a compound which contains a silver halide developing moiety and a separate moiety which contains the chromophore of an image dye). The nitroxyl radical selected must have an oxidation potential sufficient to oxidize the developer portion of the molecule, such as the hydroquinone portion. In this embodiment, the nitroxyl radical can function to immobilize the dye developer, such as when it diffuses to the receiver layer, by forming the quinone, quinonimide, etc., of the developer moiety which is generally quite insoluble in an alkaline processing solution.

In other embodiments, the nitroxyl radicals can be used to stabilize a preformed image dye. In some embodiments, the nitroxyls produce a beneficial increase in the stability of azo dyes which are transferred to an image-receiving layer.

In still other embodiments, a photographic element containing a nitroxyl oxidant can be treated to form an imagewise distribution of the oxidant. The photographic element can then be contacted with a material which will undergo oxidation to produce an image record in the photographic element. Also, the photographic element containing the imagewise distribution of oxidant can be treated to effect diffusion of the oxidant to an adjacent layer wherein it can oxidize materials to produce an image record. In one example of this embodiment, a photographic element containing a silver halide emulsion and an adjacent layer containing a nondiffusible nitroxyl oxidant can be developed with a silver halide developer. Where silver halide is not developed, the oxidant will be reduced. The element can then be contacted with a solution of color coupler and color developer to react with the remaining imagewise distribution of nitroxyl compound and produce an image dye.

The nitroxyl radicals of this invention are particularly well suited for use as oxidants in photographic elements or film units which contain an oxichromic compound of the type described in copending Lestina and Bush U.S. application Ser. No. 308,869, mentioned above and incorporated herein by reference. Preferred oxichromic compounds are those which undergo chromogenic oxidation to form a photographic image dye. In one embodiment, the nitroxyl radical oxidant incorporated into photographic elements containing oxichromic compounds of the formula:

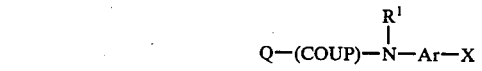

wherein (COUP) is a photographic color coupler linked to the nitrogen atom through a carbon atom at the coupling position, such as a phenolic coupler, a pyrazolone coupler, a pyrazolotriazole coupler, couplers having open-chain ketomethylene groups and the like; Ar is an arylene group containing from 6 to 20 carbon atoms, including substituted and unsubstituted arylene groups, fused-ring arylene groups and the like; X can be an amino group, including substituted amines, a hydroxyl group or the group:

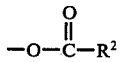

in which $R^2$ is a group containing from 1 to 12 carbon atoms, which can be an alkyl group, an aryl group, including a substituted alkyl group, a substituted aryl group and the like; $R^1$ is a hydrogen atom or the group:

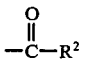

in which $R^2$ is as defined above and is preferably a polyhalogenated alkyl group; and Q is a group which is (1) a silver halide developing agent which is preferably an aromatic group polysubstituted with hydroxy, amino or substituted amino groups or (2) an oxidizable releasing group (i.e., a group which can be oxidized to facilitate subsequent release of a group or a group which can be oxidized to prevent the normal release of a group under the processing conditions. When Q is a silver halide developing agent, the resultant compound preferably is initially mobile. When Q is an oxidizable releasing group, the resultant compound preferably is initially immobile.

Typically, the present nitroxyl radicals are used in either the processing fluid or the image receiving layer of a diffusion transfer film unit employing other image dye-providing materials mentioned above. The image-transfer film units can by any of these described in the following patents, all incorporated herein by reference: U.S. Pat. Nos. 2,543,181, 2,983,606, 3,227,550, 3,227,552, 3,415,644, 3,415,645, 3,415,646 and 3,635,707, Canadian Pat. No. 674,082, and Belgian Pat. Nos. 757,959 and 757,960, both issued Apr. 23, 1971.

When used in the processing fluid of various color diffusion transfer film units, the nitroxyl radical is typically present in a concentration of about 0.01 to about 0.1 molar. When not contained in the processing fluid, the present nitroxyl radicals are coated in at least one layer which typically contains a binder such as gelatin, poly(vinyl alcohol), etc. Of course, the nitroxyl radicals described herein can also be one of several ingredients in a given layer. For example, when used in color diffusion transfer units, the nitroxyl radical can be contained in a mordant layer. In general, these nitroxyls are coated at a coverage of about 40 to 500 mg/ft$^2$. In preferred embodiments, the nitroxyl radicals are used in image-transfer film units which are designed to be processed with a single processing solution, and the resulting positive image is viewed through a transparent support against an opaque background, preferably where all of the silver halide recording layers and the image-receiving layer remain laminated between two dimensionally stable supports after processing.

A suitable image transfer film unit in which the present oxidants are useful typically comprises:

1. a photosensitive element comprising a support having thereon at least one layer containing a silver halide emulsion having associated therewith an image dye-providing material and preferably at least three of said layers wherein one layer contains a blue-sensitive silver halide emulsion, one layer contains a green-sensitive silver halide emulsion, and one layer contains a red-sensitive silver halide emulsion;

2. an image-receiving layer which can be located on a separate support superposed or adpated to be superposed on said photosensitive element or, preferably, it can be positioned in the photosensitive element on the same support adjacent to the photosensitive silver halide emulsion layers; and 3. means containing an alkaline processing composition adapted to discharge its contents within said film unit. Where the receiver layer is coated on the same support with the photosensitive silver halide layers, the support is preferably a transparent support, an opaque layer is preferably positioned between the image-receiving layer and the photosensitive silver halide layer, and the alkaline processing composition preferably contains an opacifying substance such as carbon of pH-indicator dye which is discharged into the film unit between a dimensionally stable support or cover sheet and the photosensitive element. In certain embodiments, the cover sheet can be superposed or adapted to be superposed on the photosensitive element. The image-receiving layer can be coated on the cover sheet. In certain preferred embodiments where the image-receiving layer is located in the photosensitive element, a neutralizing layer is located on the cover sheet.

The means containing the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosensitive element, hypodermic syringes, and the like.

The silver halide emulsions useful in our invention are well known to those skilled in the art and are described in *Product Licensing Index,* Vol. 92, December, 1971, publication 9232, p. 107, paragraph I, "Emulsion types"; they may be chemically and spectrally sensitized as described on page 107, paragraph III, "Chemical sensitzation," and pp. 108–109, paragraph XV, "Spectral sensitization," of the above article; they can be protected against the production of fog and can be stabilized against loss of sensitivity during keeping by employing the materials described on p. 107, paragraph V, "Antifoggants and stabilizers," of the above article; they can contain development modifiers, hardeners, and coating aids as described on pp. 107–108, paragraph IV, "Development modifiers," paragraph VII, "Hardeners"; and paragraph XII, "Coating aids," of the above article; they and other layers in the photographic elements used in this invention can contain plasticizers, vehicles and filter dyes described on p. 108, paragraph XI, "Plasticizers and lubricants," and paragraph VIII, "Vehicles," and p. 109, paragraph XVI, "Absorbing and filter dyes," of the above article; they and other layers in the photographic elements used in this invention may contain addenda which are incorporated by using the procedures described on p. 109, paragraph XVII, "Methods of addition," of the above article; and they can be coated by using the various techniques described on p. 109, paragraph XVII, "Coating procedures," of the above article, the disclosures of which are hereby incorporated by reference.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described in Minsk U.S. Pat. No. 2,882,156, issued Apr. 14, 1959, and basic polymeric mordants such as described in Cohen et al U.S. Pat. No. 3,709,690, issued Jan. 9, 1973.

Additional mordants include cationic mordants such as polymeric compounds composed of a polymer having quaternary nitrogen groups and at least two aromatic nuclei for each quaternary nitrogen in the polymer cation (i.e., having at least two aromatic nuclei for each positively charged nitrogen atom), such polymeric compounds being substantially free of carboxy groups. Useful mordants of this type are comprised of units of the following in copolymerized relationship with units of at least one other ethylenically unsaturated monomer;

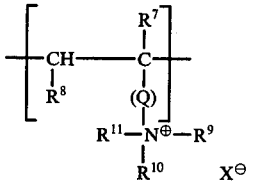

wherein $R^7$ and $R^8$ each represent a hydrogen atom or a lower alkyl radical (of 1 to about 6 carbon atoms) and $R^8$ can additionally be a group containing at least one aromatic nucleus (e.g., phenyl, naphthyl, tolyl); Q can be a divalent alkylene radical (of 1 to about 6 carbon atoms), a divalent arylene radical, a divalent aralkylene radical, a divalent arylenealkylene radical,

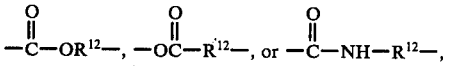

wherein $R^{12}$ is an alkylene radical, or $R^8$ can be taken together with Q to form a

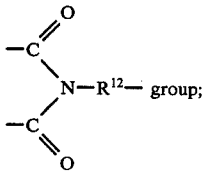

$R^9$, $R^{10}$ and $R^{11}$ can be lower alkyl or aryl, or $R^9$ and $R^{10}$ and the nitrogen atom to which they are attached can together with Q represent the atoms and bonds necessary to form a quaternized nitrogen-containing heterocyclic ring, and $X^{\ominus}$ is a monovalent negative salt forming radical or atom in ionic relationship with the positive salt forming radical; wherein said polymer is substantially free of carboxy groups and wherein the positive salt forming radical of said polymer comprises at least two aryl groups for each quaternary nitrogen atom in said polymer. These preferred polymeric cationic mordants are described further in the above-mentioned U.S. Pat. No. 3,709,690.

Other mordants useful in our invention include poly-4-vinylpyridine, the 2-vinylpyridine polymer metho-p-toluene sulfonate and similar compounds described in Sprague et al U.S. Pat. No. 2,484,430, issued Oct. 11, 1949, and cetyl trimethylammonium bromide, etc. Effective mordanting compositions are also described in Whitmore U.S. Pat. No. 3,271,148 and bush U.S. Pat. No. 3,271,147, both issued Sept. 6, 1966.

The following examples are included for a further understanding of the present invention. In these examples, all temperatures indicated are Centigrade. All oxidants referred to are found in Table I above. The structural formulas for other compounds used are found in Table IV which follows the examples. Examples 6, 7, 8, 9, 11 and 12 describes representative techniques used in the preparation of nitroxyl radicals of this invention.

EXAMPLE 1

Nitrogen gas is bubbled through a sodium hydroxide solution for 20 minutes and oxichromic compound A is added. Immediately, a deep magenta color is formed, indicating rapid hydrolysis of the acetyl group. A nitroxyl radical (Compound No. 1 of Table 1) is added and the resulting magenta solution is stirred for 15 minutes. Dilute hydrochloric acid (2.5 ml. conc. HCl in 10 ml. $H_2O$) is added to produce immediately a precipitate. The precipitate is collected, washed with water, and dried in vacuo to give 0.52 grams of the very dark solid product. This solid forms a clear yellow solution in ethanol and produces virtually one spot on a thin layer chromatographic sheet (silica, ethanol) with a trace of impurity at the origin. The major spot slowly turns black on spraying with silver nitrate im ammonia, indicating the presence of a hydroquinone. The product, which is substantially insoluble in most solvents except base, is chromatographed through fluorosil (8 × 3 cm) as follows. A solution is made by repeatedly stirring the solid in hot ethanol (100 ml. a time). The solution is diluted with ethylacetate (100 ml.) and then is passed through the chromatographic column. The process is repeated six times until most of the solid is dissolved. The product comes off the column very rapidly as a deep magenta color solution. That solution is evaporated to dryness in vacuo and the residual green residue is stirred with ethyl acetate (50 ml.) to give a solid. This solid is collected by filtration, washed with ethyl acetate, and dried to give 0.3 grams of the greenish magenta solid product, mp 223°-225°. The theoretical values calculated for $C_{31}H_{35}Cl_2N_6O_4$ and the values actually found are as follows:

Calculated: C, 60.0; H, 4.9; N, 13.5.

Found: C, 59.8; H, 5.9; N, 13.0. The analysis coupled with the electrochemical and I. R. data indicate definitely that the chromophoric moiety of oxichromic compound A is oxidized to magenta dye (Compound B) without affecting the hydroquinone moiety of the molecule.

EXAMPLE 2

A. A matrix element is prepared comprising a transparent poly(ethylene terephthalate) support having thereon a layer of gelatin and oxichromic compound C at coverages of 250 and 50 mg/ft$^2$, respectively. A receiver element is prepared comprising a reflection support having thereon a layer of gelatin at a coverage of 250 mg/ft$^2$. These two elements are placed in face-to-face contact for ten seconds with a processing composition, comprising 4% potassium hydroxide and 2.5% hydroxyethylcellulose (Natrasol 250HH, trademark), spread between the elements. After treatment, the matrix is spectrophotometrically evaluated by determining the density to red light of any dye formed from colorless Compound C. The reflection density is 0.3.

B. Procedure A above is repeated using a receiver element which additionally contains 100 mg/ft$^2$ of Compound No. 1 in the gelatin layer. After treatment, drying and evaluation as above, the receiver is found to have a red density of 1.8. These results indicate the effectiveness of the oxidant (compound No. 1) in transferring the initially colorless oxichromic compound C to the corresponding cyan dye.

EXAMPLE 3

The oxidants listed in Table II below are tested as follows: A matrix element comprised of a transparent film base support having a layer of 125 mg/ft$^2$ gelatin and 50 mg/ft$^2$ of oxichromic compound dissolved in 75 mg/ft$^2$ of diethyl lauramide in the presence of an alkaline processing composition is placed in face-to-face contact with a receiver comprising a transparent film base support having on it a first layer of 200 mg/ft$^2$ of the mordant copoly[styrene:N,N-dimethyl-N-benzyl-N-3-maleiimidopropyl)ammonium chloride] in 100 mg/ft$^2$ of gelatin and a second layer (over the first layer) comprising 2000 mg/ft$^2$ of titanium dioxide in 200 mg/ft$^2$ of gelatin. The processing composition contains 20 g. of oxidant per liter of the potassium hydroxide-hydroxyethylcellulose composition of Example 2. Upon contact of the two elements, the oxichrome migrates from the matrix through the processing composition and the titanium dioxide layer into the mordant layer of the receiver. The oxichrome is oxidized by the nitroxyl oxidant to the corresponding dye which is visible through the transparent support and against the white background of the titanium dioxide layer. The oxichromic compounds, the oxidants and the color of the dye in the receiver are shown in Table II below.

Table II

| Oxidant | Oxichromic Compound | Color of Dye in Receiver |
|---|---|---|
| 1 | D | Cyan |
| 2 | D | Cyan |
| 3 | D | Cyan |
| 6 | D | Cyan |
| 15 | D | Cyan |
| 22 | D | Cyan |
| 14 | A | Magenta |
| 15 | A | Magenta |
| 16 | A | Magenta |
| 22 | A | Magenta |
| 1 | E | Yellow |
| 2 | E | Yellow |
| 3 | E | Yellow |
| 22 | E | Yellow |

EXAMPLE 4

The oxidants listed in Table III below are tested using the elements of Example 3 in which an oxidant is located in the mordant layer or in a separate adjacent layer at a concentration of 200 mg/ft$^2$. The processing composition of Example 2 is used as described in the preceding examples. The oxidants and oxichromic compounds used as well as the color of the dye in the receiver are shown in Table III.

Table III

| Oxidant | Oxichromic Compound | Color of Dye in Receiver |
|---|---|---|
| 13 | D | Cyan |
| 18 | D | Cyan |
| 19 | D | Cyan |
| 13 | A | Magenta |
| 18 | A | Magenta |
| 19 | A | Magenta |
| 13 | E | Yellow |
| 18 | E | Yellow |
| 19 | E | Yellow |

EXAMPLE 5

An integral, color transfer, photographic element is prepared as follows (the full identification of certain components follows the examples):

1. transparent polyethylene terephthalate support;
2. dye mordant layer containing gelatin at 100 mg/ft$^2$, copoly[styrene:N-benzyl-N,N-dimethyl-N-(3-maleimidopropyl)ammonium chloride] at 200 mg/ft$^2$ and nitroxyl oxidant No. 20 at 200 mg/ft$^2$;
3. layer containing titanium dioxide at 2000 mg/ft$^2$ and gelatin at 200 mg/ft$^2$;

4. layer containing carbon opacifying agent at 20 mg/ft² and gelatin at 156 mg/ft²;
5. layer containing gelatin at 75 mg/ft², 2,5-di-sec-dodecylhydroquinone at 70 mg/ft² and tricresyl phosphate at 23 mg/ft².
6. layer containing a red-sensitive silver bromoiodide emulsion at 70 mg/ft² based on silver, gelatin at 230 mg/ft², Compound C at 42 mg/ft² dispersed in diethyl lauramide at 73 mg/ft², 5-(2-cyanoethylthio)-1-phenyltetrazole at 5 mg/ft² dispersed in tricresyl phosphate at 15 mg/ft² and 5,6,7,8-tetrahydro-5,8-methano-1,4-naphthalenediol at 10 mg/ft²;
7. layer containing gelatin at 300 mg/ft², 2,5-di-sec-dodecylhydroquinone at 70 mg/ft² and a magenta filter dye at 30 mg/ft² dissolved in diethyl lauramide at 50 mg/ft²;
8. layer containing green-sensitive silver bromoiodide emulsion at 70 mg/ft² based on silver, gelatin at 230 mg/ft², oxichromic compound A at 54 mg/ft² dispersed in diethyl lauramide at 64 mg/ft², 5-(2-cyanoethylthio)-1-phenyltetrazole at 5 mg/ft² dispersed in tricresyl phosphate and 5,6,7,8-tetrahydro-5,8-methano, 1,4-naphthalenediol at 10 mg/ft²;
9. layer containing gelatin at 300 mg/ft², 2,5-di-sec-dodecylhydroquinone at 70 mg/ft² and a yellow filter dye at 100 mg/ft² dispersed in diethyl lauramide at 28 mg/ft²;
10. layer containing a blue-sensitive silver bromoiodide emulsion at 70 mg/ft² based on silver, gelatin at 210 mg/ft², oxichromic compound F at 64 mg/ft² dispersed in diethyl lauramide at 100 mg/ft², 5-(2-cyanoethylthio)-1-phenyltetrazole at 5 mg/ft² dispersed in tricresyl phosphate at 15 mg/ft² and 5,6,7,8-tetrahydro-5,8-methano-1,4-naphthalenediol at 10 mg/ft¹;
11. layer containing gelatin at 50 mg/ft². A transparent cover sheet for the above element is prepared as follows:
1. transparent polyethylene terephthalate support;
2. layer containing gelatin at 900 mg/ft², polyacrylic acid at 900 mg/ft² and imidazole at 760 mg/ft²;
3. layer containing cellulose acetate at 1140 mg/ft² and copoly(styrene-maleic anhydride) at 60 mg/ft². The photographic element is exposed through a multicolor, graduated-density test object, the transparent cover sheet superposed on the element, and a pod containing an opaque processing composition is ruptured to discharge between the cover sheet and the photosensitive element by passing the film unit through juxtaposed rollers having a gap of about 8 mils. The processing composition is as follows:

| | |
|---|---|
| Potassium hydroxide | 51 g/l |
| hydroxyethyl cellulose | 30 g/l |
| potassium bromide | 40 g/l |
| α-benzylpicolinium bromide | 15 g/l |
| 5,6,7,8-tetrahydro-5,8-methano-1,4-naphthalenediol | 15 g/l |
| carbon | 40 g/l |

After about 1 to 2 minutes, a well-defined color image with excellent color reproduction is viewed through the transparent support of the integral element.

EXAMPLE 6 - PREPARATION OF OXIDANT NO. 5

An 8.6 g. quantity of 4-amino-2,3,6,6-tetramethylpiperidine-1-oxyl is dissolved in 200 ml. of acetonitrile. Next, 17.6 grams of octadecylsuccinic anhydride are added to the solution followed by stirring overnight at room temperature. The solids are then collected on a Buchner funnel, washed with acetonitrile, and dried. The product consists of 25 g. of a fine pinkish solid, which softens to a gel at mp 60°-63°.

EXAMPLE 7 - PREPARATION OF OXIDANT NO. 10

A g. quantity of phthalic anhydride is dissolved in 200 ml. of acetonitrile and 17.1 grams of 4-amino-2,2,6,6-tetramethylpiperidine-1-oxyl are added slowly. A precipitate forms immediately. The mixture is allowed to stand overnight at room temperature and the solids collected on a Buchner funnel, washed with acetonitrile and dried. The product consists of 12 grams of a fine pinkish solid, mp 167°-170°.

EXAMPLE 8 - PREPARATION OF OXIDANT NO. 11

A 5 g. quantity of isocyanate is added to a solution of 4-amino-2,2,6,6-tetramethylpiperidine-1-oxyl in dioxane. The solution is heated for 2 hours on a steampot, then filtered. The filtrate is concentrated to dryness, acetonitrile is added with stirring and the solids are collected on a Buchner funnel. The product consists of 3.3 grams of an off-white solid, mp 100°-100°.

EXAMPLE 9 - PREPARATION OF OXIDANT NO. 19

4-Amino-2,2,6,6-tetramethylpiperidine-1-oxyl (8.6 g.) is dissolved in 250 ml. of acetonitrile. Five grams of triethylamine are added, followed by the addition of 19.49 g. of n-pentadecylphenylsulfonyl chloride. The solution is stirred at room temperature overnight. The mixture is filtered to remove salt and the red filtrate is concentrated to dryness. Chloroform is added to the dry solid and the resultant solution is chromatographed on a Florisil column using ethyl acetate as the eluant. The first fraction collected is concentrated to dryness. A fine solid residue remains which, when recrystallized from hexane, provides 5.6 grams of product, mp 93°-95°.

EXAMPLE 10

A matrix element is prepared comprising a transparent poly(ethylene terephthalate) support having thereon a layer of gelatin (125 mg/ft²) over which is a layer of 2,000 mg/ft² of titanium dioxide in 200 mg/ft² of gelatin. In the presence of the alkaline processing composition, the matrix element is placed in face-to-face contact with a receiver comprising a transparent support having thereon a layer of about 200 mg/ft² of tributyloctadecylammonium bromide (mordant), 100 mg/ft² of gelatin and 200 mg/ft² of nitroxyl radical No. 16 of Table I. After sixty seconds, the cyan dye resulting in the receiver element has a density of 2.0.

EXAMPLE 11 - PREPARATION OF COMPOUND NO. 20

In a 22 liter flask are placed 9 Kg of dry acetonitrile followed by 380 g. (2.22 moles) of 4-amino-2,2,6,6-tetramethylpiperidine-1-oxyl. With stirring, 300 g. (2.22 moles) of triethylamine are added, then 690 g. (2.22 moles) of 2,4-di-t-pentylphenoxyacetyl chloride are added. The solution is stirred at room temperature overnight. The mixture is concentrated to about ½ volume and the salt collected and discarded. The filtrate is concentrated to dryness. Ethyl acetate is added to the residue to dissolve the radical and any additional salts collected and discarded. The filtrate is divided into two approximately equal portions and each portion is then chromatographed on a Florisil column (approximately 6 inches in diameter by 17 inches long). The red fractions are combined and concentrated to dryness (using heat, 50°-60°, under aspirator vacuum during final drying). This treatment yields 841 g. (85%) of a very thick red tar.

EXAMPLE 12 - PREPARATION OF COMPOUND NO. 34

This compound is prepared in essentially the same way as Compound No. except that the amine is 4-hydroxy-2,2,6,6-tetramethylpipendine-1-oxyl. The product is chromatographed on a Florisil column. Upon concentration, a viscous liquid remained which solidifies on standing, m.p. 58°-64°.

Table IV below gives the structures of Compounds A through G referred to in the preceding examples.

Table IV

| Compound | Formula |
|---|---|
| A | 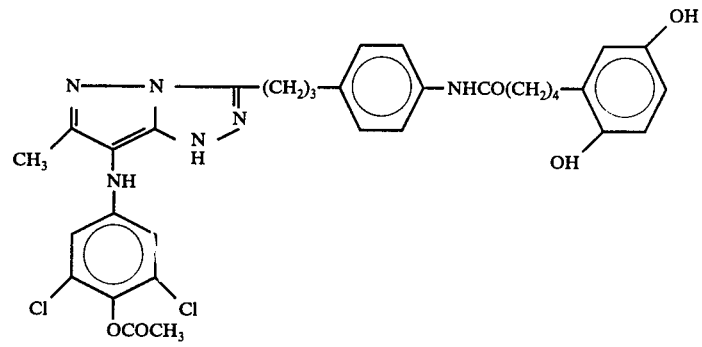 |
| B | 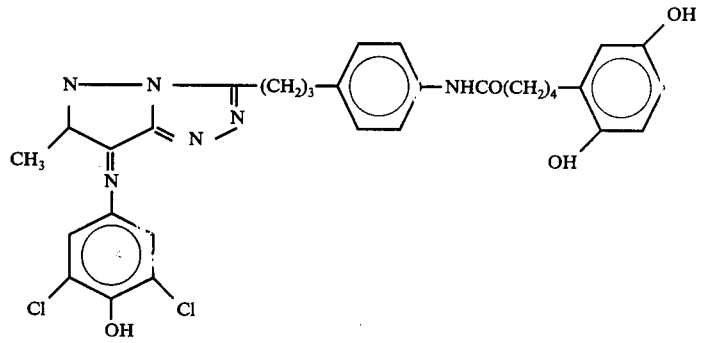 |
| C | 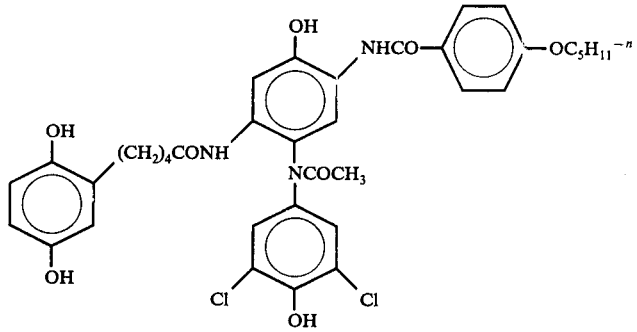 |
| D | 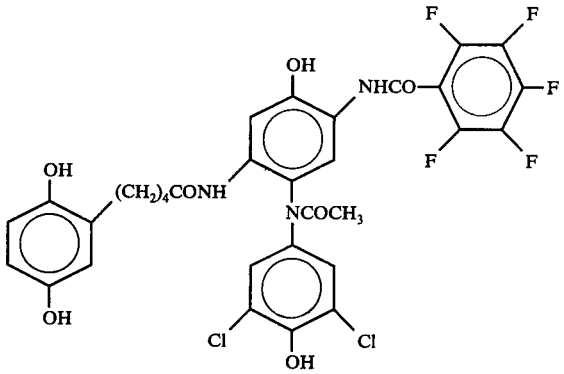 |

Table IV-continued

| Compound | Formula |
|---|---|
| E | 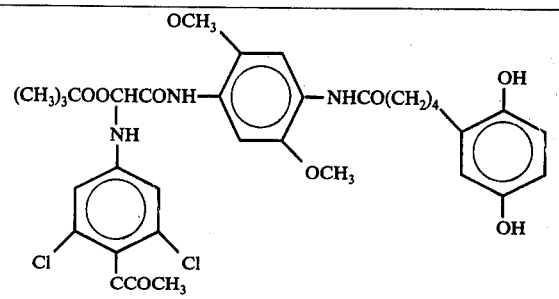 |
| F | 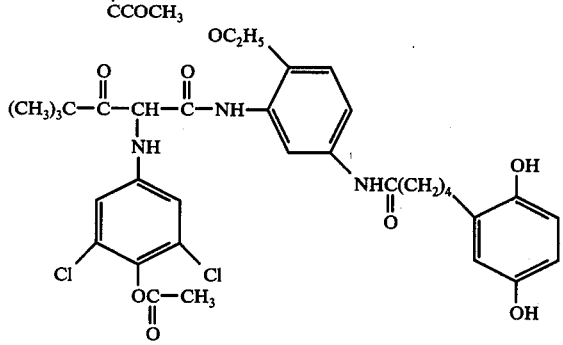 |
| G | 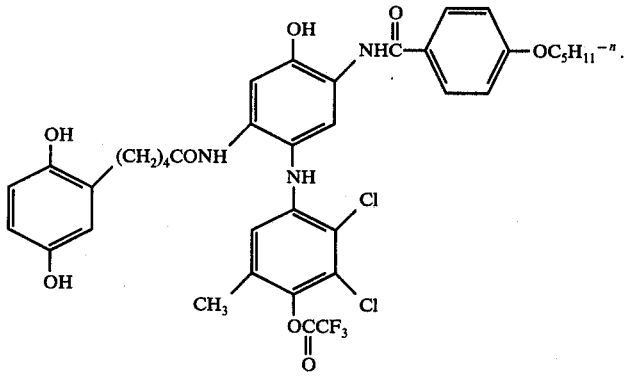 |

The term "image dye-providing material" as used herein is understood to refer to those compounds which either (1) do not require a chemical reaction to form the image dye or (2) undergo reactions encountered in photographic imaging systems to produce an image dye, such as with color couplers, oxichromic compounds and the like. The first class of compounds is generally referred to as preformed images dyes and includes shifted dyes, etc, while the second class of compounds is generally referred to as dye precursors.

The terms "initially mobile" and "initially immobile" as used herein refer to compounds which are incorporated in the photographic element and, upon contact with an alkaline processing solution, are substantially mobile or substantially immobile, respectively.

The invention has been described in detail with particular reference to certain preferred embodiments thereof, but it will be understood that variations and modifications can be effected within the spirit and scope of the invention.

We claim:

1. A photographic element comprising a support having thereon at least one photographic image dye receiving layer and at least one layer containing a compound to oxidize a dye-providing material such that imagewise discrimination is produced in the element, said compound being of the formula

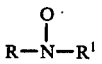

wherein:

R and $R^1$, each represents (1) an alkyl group having no hydrogen on the α-carbon atom or (2) an aryl group substituted with an alkyl group of from 1–19 carbon atoms, an alkoxy group of from 1–19 carbon atoms or a nitro group.

2. A photographic element comprising a support having thereon at least one photosensitive silver halide emulsion layer and at least one layer containing a compound to oxidize a dye-providing material such that imagewise discrimination is produced in the element, said compound being of the formula

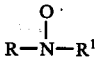

wherein:

R and $R^1$, each represents (1) an alkyl group having no hydrogen on the α-carbon atom or (2) an aryl group substituted with an alkyl group of from 1–19 carbon atoms, an alkoxy group of from 1–19 carbon atoms or a nitro group.

3. A photographic film unit comprising:

a. a photosensitive element comprising a support having thereon a photosensitive silver halide emulsion having associated therewith an image dye-providing compound;

b. an image dye-receiving layer; and c. means containing an alkaline processing composition and for discharging said processing composition within said film unit; said film unit containing a compound to oxidize a dye-providing material such that imagewise discrimination is produced in the film unit, said compound being of the formula

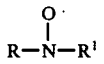

wherein:

R and $R^1$, each represents (1) an alkyl group having no hydrogen on the α-carbon atom or (2) an aryl group substituted with an alkyl group of from 1–19 carbon atoms, an alkoxy group of from 1–19 carbon atoms or a nitro group.

4. In a photographic process wherein an imagewise-exposed photographic silver halide emulsion is developed and wherein an image dye-providing material is oxidized to provide an image dye record, the improvement wherein said material is oxidized by a stable free nitroxyl radical, said radical being of the formula

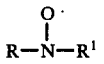

wherein:

R and $R^1$, each represents (1) an alkyl group having no hydrogen on the α-carbon atom or (2) an aryl group substituted with an alkyl group of from 1–19 carbon atoms, an alkoxy group of from 1–19 carbon atoms or a nitro group.

5. A photographic film unit comprising:

a. a photosensitive element comprising a support having thereon a photosensitive silver halide emulsion having associated therewith an oxichromic compound, said oxichromic compound capable of undergoing chromogenic oxidation to form a photographic image dye;

b. an image dye-receiving layer;

c. means containing an alkaline processing composition; and d. means for discharging said processing composition within said film unit; said processing composition containing a stable free nitroxyl radical, said radical being of the formula

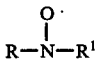

wherein:

R and $R^1$, when taken separately, each represents (1) an alkyl group having no hydrogen on the α-carbon atom or (2) an aryl group substituted with an alkyl group of from 1–19 carbon atoms, an alkoxy group of from 1–19 carbon atoms or a nitro group and R and $R^1$, when taken together, represent the non-metallic atoms necessary to complete a 5-, 6-, or 7-membered heterocyclic nucleus having no hydrogen on carbon atoms adjacent the nitrogen atom of the formula.

6. The film unit as defined in claim 5 wherein said radical has the formula

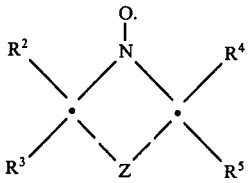

wherein:

$R^2$, $R^3$, $R^4$ and $R^5$, when taken separately, represent a lower alkyl group;

$R^2$ and $R^3$ or $R^4$ and $R^5$, together with the carbon atoms to which they are attached, represent (1) the carbon atoms necessary to form a 5- or 6-membered cycloalkyl or cycloalkenyl nucleus; (2) an imino group or (3) a heterocyclic nitroxyl radical;

when taken together with Z, one of $R^3$ and $R^5$ represents a double bond in the cyclic nucleus formed by Z, and $R^2$ or $R^4$, respectively, represents (1) an aryl group or (2) an amino group;

Z represents the nonmetallic atoms necessary to complete a 5-, 6- or 7-membered heterocyclic nucleus.

7. The photographic unit as defined in claim 5 wherein said oxichromic compound is a member selected from the group consisting of leuco indoanilines, leuco indophenols, leuco triarylmethanes, and leuco anthraquinones.

8. The photographic unit as defined in claim 5 wherein said oxichromic compound has the formula:

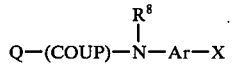

wherein:

(COUP) is a photographic color coupler linked to the nitrogen atom through a carbon atom at the coupling position;

Ar is an arylene group;

X is selected from an amino group, a hydroxyl group or a group having the formula:

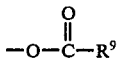

wherein $R^9$ is an alkyl or aryl group;

$R^8$ is a hydrogen atom or a group having the formula:

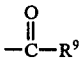

wherein $R^9$ is as defined above; and

Q is a silver halide developing agent or an oxidizable releasing group.

9. In a photographic process wherein an imagewise-exposed photographic silver halide emulsion is developed and wherein an oxichromic compound is oxidized to provide an image dye record, said oxichromic compound capable of undergoing chromogenic oxidation to form a photographic image dye, the improvement wherein said oxichromic compound is oxidized by a stable free nitroxyl radical, said radical being of the formula

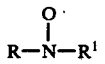

wherein:

R and $R^1$, when taken separately, each represents (1) an alkyl group having no hydrogen on the α-carbon atom or (2) an aryl group substituted with an alkyl group of from 1–19 carbon atoms, an alkoxy group of from 1–19 carbon atoms or a nitro group and R and $R^1$, when taken together, represent the non-metallic atoms necessary to complete a 5-, 6-, or 7-membered heterocyclic nucleus having no hydrogen on carbon atoms adjacent the nitrogen atom of the formula.

* * * * *